US010948844B2

(12) United States Patent
Toyoizumi et al.

(10) Patent No.: US 10,948,844 B2
(45) Date of Patent: Mar. 16, 2021

(54) COLOR IMAGE FORMING APPARATUS

(71) Applicant: CANON KABUSHIKI KAISHA, Tokyo (JP)

(72) Inventors: Kiyoto Toyoizumi, Yokohama (JP); Masaru Shimura, Yokohama (JP); Shinsuke Kobayashi, Yokohama (JP); Hideo Nanataki, Yokohama (JP); Shinji Katagiri, Yokohama (JP); Yasunari Watanabe, Kawasaki (JP); Hideaki Hasegawa, Tokyo (JP); Masahiro Tambo, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/446,395

(22) Filed: Jun. 19, 2019

(65) Prior Publication Data

US 2019/0302639 A1 Oct. 3, 2019

Related U.S. Application Data

(60) Division of application No. 15/669,784, filed on Aug. 4, 2017, now Pat. No. 10,372,058, which is a continuation of application No. 13/312,708, filed on Dec. 6, 2011, now abandoned.

(30) Foreign Application Priority Data

Dec. 10, 2010 (JP) ..... 2010-276173
Nov. 15, 2011 (JP) ..... 2011-249918

(51) Int. Cl.

| | |
|---|---|
| ***G03G 15/04*** | (2006.01) |
| ***G03G 15/043*** | (2006.01) |
| ***G03G 15/047*** | (2006.01) |
| ***G03G 15/32*** | (2006.01) |
| ***B41J 2/44*** | (2006.01) |
| ***B41J 2/47*** | (2006.01) |

(52) U.S. Cl.

CPC ..... *G03G 15/047* (2013.01); *B41J 2/442* (2013.01); *B41J 2/471* (2013.01); *G03G 15/043* (2013.01); *G03G 15/04072* (2013.01); *G03G 15/326* (2013.01)

(58) Field of Classification Search

CPC ..... G03G 15/04072; G03G 15/043; G03G 15/047; G03G 15/326; B41J 2/442; B41J 2/471

See application file for complete search history.

(56) References Cited

U.S. PATENT DOCUMENTS

2006/0120739 A1* 6/2006 Denton ..... G03G 15/04054 399/49
2009/0110015 A1* 4/2009 Heink ..... B41J 2/473 372/38.02

* cited by examiner

*Primary Examiner* — Matthew Luu
*Assistant Examiner* — Kendrick X Liu
(74) *Attorney, Agent, or Firm* — Canon U.S.A., Inc. IP Division

(57) ABSTRACT

A controller which causes a light emitting element to continuously perform minute emission for a plurality of dots in a level in which toner is not attached to a non-image section on an image bearing member is provided. The controller controls a first driving current for an image section and controls a second driving current used to perform the minute emission by the light emitting element in the non-image section several times in one job. In the image section, a driving current obtained by adding the first driving current to the second driving current is supplied so that the light emitting element emits light.

16 Claims, 11 Drawing Sheets

COLOR IMAGE FORMING APPARATUS

CROSS-REFERENCE TO RELATED APPLICATION

This application is a Divisional of U.S. application Ser. No. 15/669,784, filed Aug. 4, 2017; which is a Continuation of U.S. application Ser. No. 13/312,708, filed Dec. 6, 2011, now abandoned on Dec. 29, 2017; which claims priority from Japanese Patent Application No. 2010-276173 filed Dec. 10, 2010 and No. 2011-249918 filed Nov. 15, 2011, which are hereby incorporated by reference herein in their entireties.

BACKGROUND OF THE INVENTION

Field of the Invention

The present invention relates to a color image forming apparatus, such as a laser printer, a photocopier, or a facsimile, which employs an electrophotography recording method.

Description of the Related Art

In general, in color image forming apparatuses, a phenomenon which is so-called "white gap" in which an irregular white gap, which is not intended to be generated, is generated between adjacent images of different colors has occurred. This phenomenon occurs in the following situation. Specifically, an electrostatic latent image obtained by a rapidly changing potential of a surface of a photoconductor drum, that is an image edge portion, is generated on the photoconductor drum. Then, when this portion is developed by a developing apparatus, a developed image having a width smaller than that of a developed image intended to be formed is generated. In an image including a cyan band and a black band which are adjacent to each other, for example, although the cyan band and the black band should be closely adjacent to each other, a gap is generated between the cyan band and the black band in a final image generated on a recording material since a developed image of the cyan band and a developed image of the black band are formed with smaller widths.

FIG. 12 is a diagram used to explain the white gap in detail and shows a state of an electric field generated between a developer roller and a photoconductor drum. A smaller width of a developed image in an image developing portion causes a white gap since the electric field winds around an edge portion of an electrostatic latent image formed in an electrostatic portion on a photoconductor drum.

To address this problem, a method for performing minute emission using a light emitting element of a laser scanner on a non-image section (non-toner-image-forming unit) in an entire printable region of the photoconductor drum to the extent that toner attachment does not occur has been used, so that the width of the image is prevented from being small. Hereinafter, this method is referred to as "background exposure", "non-image-section minute emission", or the like.

Note that an object for performing the non-image-section minute emission is not limited to the prevention of generation of the white gap. For example, as disclosed in Japanese Patent Laid-Open No. 2003-312050, the non-image-section minute emission is performed for making contrast of a transfer potential smaller and preventing image disturbance which occurs in a gap between the developing roller and the photoconductor drum in accordance with aerial discharge. Specifically, the non-image-section minute emission is not performed for a limited usage.

Here, as a concrete method for performing the non-image-section minute emission, a method for changing a duty ratio of a pulse wave which is referred to as a PWM (Pulse Width Modulation) method has been proposed in Japanese Patent Laid-Open No. 2003-312050. In this method, a light emitting element of a laser scanner emits light in a non-image section with a pulse width corresponding to an intensity of minute emission in synchronization with an image clock which has a fixed frequency.

In recent years, there is a demand for higher-quality images generated by color image forming apparatuses. Therefore, in addition to control of an intensity of emission light corresponding to an image section, appropriate control of an intensity of light of minute emission in the non-image section is required.

SUMMARY OF THE INVENTION

According to an embodiment of the present invention, there is provided an image forming apparatus which includes a light emitting element which emits a laser beam, a photoconductor drum, and a charging unit which charges the photoconductor drum, which forms a latent image by radiating light emitted from the light emitting element on the charged photoconductor drum, and in which toner attaches to the latent image so that the image becomes visible. The image forming apparatus comprising a laser driving unit configured to cause the light emitting element to emit light with an intensity corresponding to a first emission level for printing for a period of time corresponding to a pulse duty in an image section of the latent image being formed on the photoconductor drum and to cause the light emitting element to emit light with an intensity corresponding to a second emission level for minute emission on a non-image section of the latent image being formed on the photoconductor drum, a first light-intensity controller configured to control a first driving current used to cause the light emitting element to emit light with an intensity corresponding to the first emission level several times in one job, and a second light-intensity controller configured to control a second driving current used to cause the light emitting element to emit light with an intensity corresponding to the second emission level several times in one job. The laser driving unit adds the first driving current to the second driving current so as to cause the light emitting element to emit light by the intensity of light corresponding to the first emission level. The first light-intensity controller controls the first driving current to be added to the second driving current.

Accordingly, the light emission may be performed in an image section by a stable intensity of light and minute emission may be performed in a non-image section. Consequently, a high-quality image may be obtained.

Further features of the present invention will become apparent from the following description of exemplary embodiments with reference to the attached drawings.

DESCRIPTION OF THE EMBODIMENTS

First Embodiment

Embodiments of the present invention will be described hereinafter with reference to the accompanying drawings. Note that components disclosed in the embodiments are merely examples and the scope of the present invention is not limited to these.

Schematic Sectional View of Image Forming Apparatus

Figure 1:
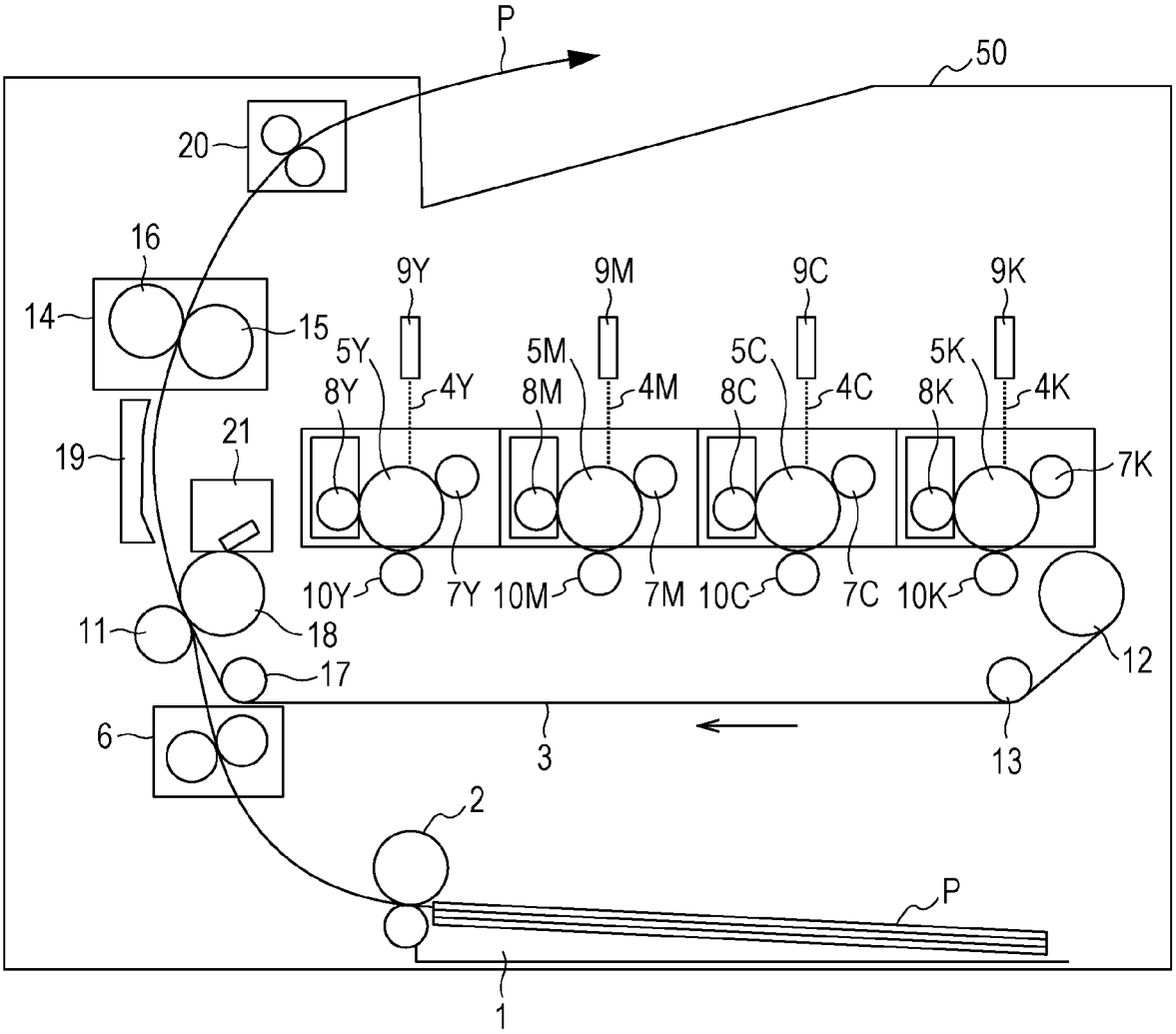
FIG. 1 is a sectional view schematically illustrating an image forming apparatus.

FIG. 1 is a sectional view schematically illustrating a color image forming apparatus. Note that, although a description will be made taking the color image forming apparatus as an example below, the present invention is not limited to this. Minute emission performed by a non-image section which will be described hereinafter may be employed in a monochrome image forming apparatus. Furthermore, although the description will be made taking an in-line color image forming apparatus as an example, a rotary color image forming apparatus may be used, for example. Furthermore, although the description will be made taking an image forming apparatus having an intermediate transfer belt 3 as an example hereinafter, an image forming apparatus employing a method for directly transferring toner images developed in photoconductor drums 5 on a transfer material may be used. Hereinafter, an example of an in-line color image forming apparatus which employs an intermediate transfer belt method will be described in detail.

As shown in FIG. 1, a color laser printer 50 including the photoconductor drums 5 (5Y, 5M, 5C, and 5K) serving as first image bearing members performs sequential multiple transfer on the intermediate transfer belt 3 serving as a second image bearing member so as to obtain a full-color print image. This method is referred to as an "in-line method" or a "four-drum method".

The intermediate transfer belt 3 is an endless belt rotating in a process speed of 115 mm/sec in a direction denoted by an arrow mark shown in FIG. 1 and is hung across a driving roller 12, a tension roller 13, an idler roller 17, and a secondary transfer counter roller 18. The driving roller 12, the tension roller 13, and the secondary transfer counter roller 18 are support rollers which support the intermediate transfer belt 3. The driving roller 12 and the secondary transfer counter roller 18 have diameters of φ924 (mm) and the tension roller 13 has a diameter of φ16 (mm).

The four photoconductor drums 5 (5Y, 5M, 5C, and 5K) are arranged in series in a direction in which the intermediate transfer belt 3 moves. The photoconductor drum 5Y having a yellow developer 8Y is uniformly subjected to a charge process performed by a primary charge roller 7Y so as to obtain a predetermined polar characteristic and a predetermined potential in a rotation process, and subsequently, is subjected to image exposure 4Y performed by an image exposure unit 9Y. By this, an electrostatic latent image corresponding to a first-color (yellow) component image of a target color image is formed. Next, the first developer (yellow developer) 8Y performs development by attaching a yellow toner which is a first color to the electrostatic latent image. By this, the image becomes visible. As described above, a method for performing development using toner in a portion in which the electrostatic latent image is formed by image exposure is referred to as a "reversal developing method".

The yellow image formed on the photoconductor drum 5Y enters a primary transfer nip formed with the intermediate transfer belt 3. In the primary transfer nip, a voltage applying member (primary transfer roller) 10Y abuts on a back surface of the intermediate transfer belt 3. To the voltage applying member 10Y, a primary transfer bias power source, not shown, which is used to apply a bias is connected. The intermediate transfer belt 3 transfers yellow in a first color part, and thereafter, successively performs multiple transfer of magenta, cyan, and black, in this order using the photoconductor drums 5M, 5C, and 5K which correspond to these colors and which have been subjected to the process described above. A toner image which has the four colors and which has been transferred on the intermediate transfer belt 3 revolves along with the intermediate transfer belt 3 in the direction (clockwise direction) denoted by the arrow mark in FIG. 1.

On the other hand, a recording member P which is mounted on and stored in a sheet-feeding cassette is fed by a feeding roller 2 so as to be supplied to a nip of a registration roller pair 6, and then, the feeding is temporarily stopped. The recording member P which has been temporarily stopped is supplied to a secondary transfer nip by the registration roller pair 6 in synchronization with a timing when the toner image of four colors formed on the intermediate transfer belt 3 arrives in the secondary transfer nip. Then, the toner image formed on the intermediate transfer belt 3 is transferred on the recording member P by a voltage (approximately 1.5 kV) applied between a secondary transfer roller 11 and the secondary transfer counter roller 18.

The recording member P to which the toner image is transferred is separated from the intermediate transfer belt 3 and supplied to a fixing apparatus 14 through a conveyance guide 19. Here, a fixing roller 15 and a pressure roller 16 perform heating and pressurizing on the recording member P so that the toner image is melted and fixed to a surface of the recording member P. In this way, a full-color image having the four colors is obtained. Thereafter, the recording member P is ejected from the apparatus through an ejection roller pair 20, and one print cycle is terminated. On the other hand, toner which has not been transferred to the recording member P by the secondary transfer unit and accordingly remains in the intermediate transfer belt 3 is removed by a cleaning unit 21 disposed on a downstream side of the secondary transfer unit.

The schematic sectional view of the image forming apparatus has been described hereinabove. Next, hereinafter, as for a laser driving system, an appearance of an optical scanning apparatus (corresponding to the image exposure units 9) will be described first, and thereafter, a circuit configuration of a laser driving system will be described in detail.

Appearance of Optical Apparatus

Figure 2:
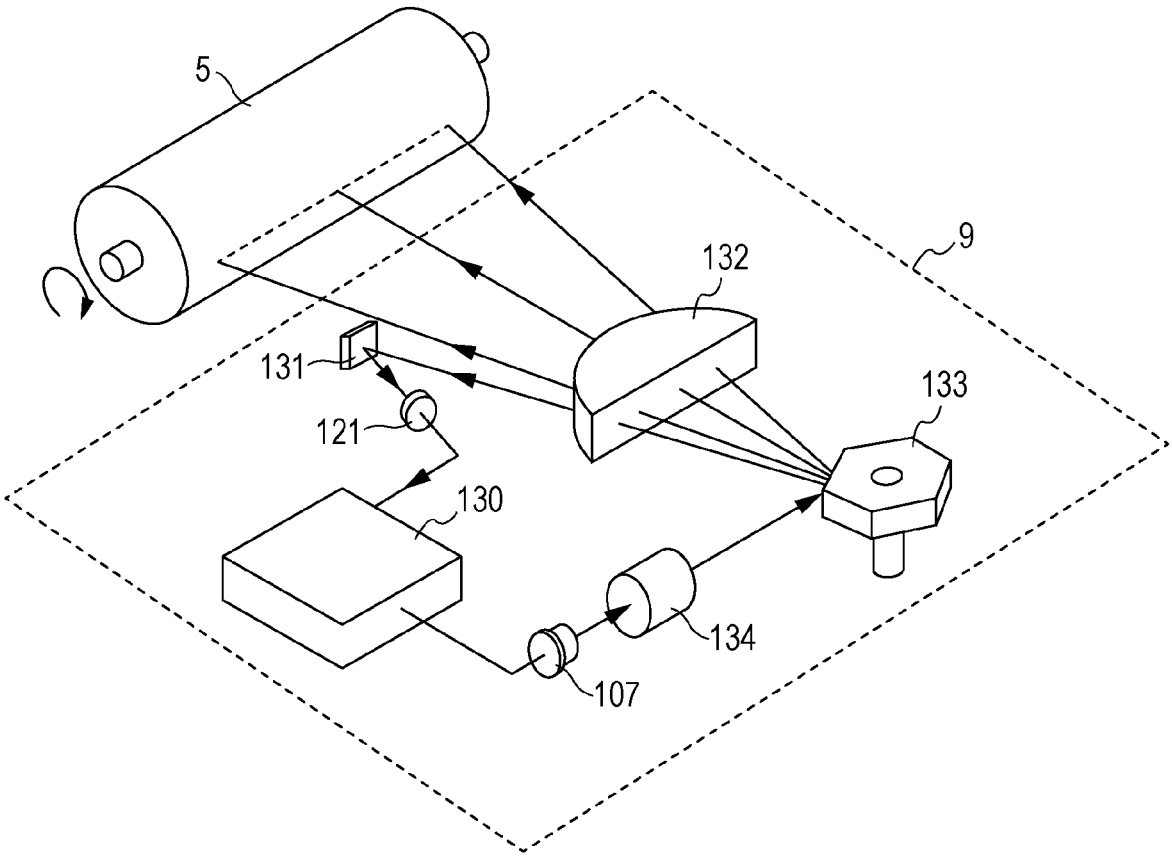
FIG. 2 is a diagram illustrating an appearance of an optical scanning apparatus.

FIG. 2 is a diagram illustrating an appearance of a typical optical scanning apparatus. To a laser diode 107 (hereinafter referred to as an LD 107) serving as a light emitting element, a driving current is supplied when a laser driving system circuit 130 operates. The LD 107 emits a laser beam having an intensity level corresponding to the driving current. The laser driving system circuit 130 drives the LD 107 which is electrically connected thereto, as are an engine controller 122 and a video controller 123 which will be described hereinafter.

Then, the laser beam emitted from the LD 107 is shaped by a collimator lens 134 so that a parallel beam is obtained. Then, the parallel beam is scanned by a polygon mirror 133 in a horizontal direction of the photoconductor drums 5. Then the scanned laser beam encounters a surface of a photoconductor drum which is axially rotated, passes through an fθ lens 132 for image formation, and is exposed as dots.

Meanwhile, a reflection mirror 131 is disposed so as to correspond to a scanning position at one end of the photoconductor drums 5. The reflection mirror 131 reflects the laser beam to be projected on a scanning start position toward a BD synchronization detection sensor 121. Then, a timing when the scanning of the laser beam is started is determined in accordance with a signal output from the BD synchronization detection sensor 121. Here, when forcible light emission is performed for the detection of the laser beam, APC (Auto Power Control) which is automatic light intensity control is performed on an intensity of the laser beam so that an emission level of the laser beam is controlled.

Diagram of Laser Driving System Circuit

Figure 3:
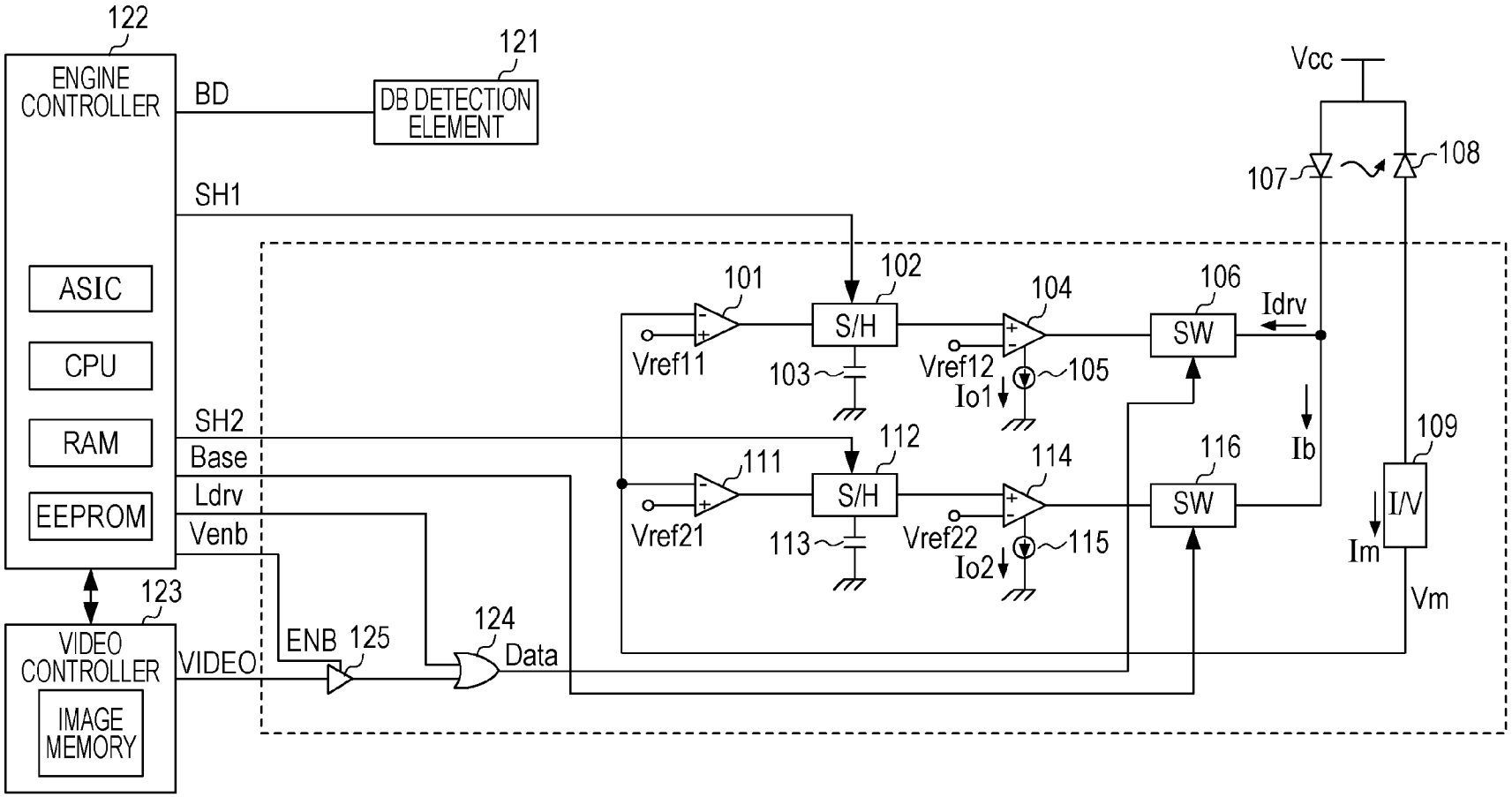
FIG. 3 is a diagram illustrating a laser driving circuit including a two-level light intensity control function.

FIG. 3 is a diagram illustrating a laser driving system circuit which automatically controls a light intensity level of the LD 107 when, in the non-image section, minute emission is performed so that the toner is prevented from being attached to the photoconductor drum and normal fogging and reversal fogging are prevented from being generated.

In FIG. 3, the laser driving system circuit 130 shown in FIG. 2 corresponds to a portion defined by a dotted frame. Reference numerals 101 and 111 denote comparator circuits, reference numerals 102 and 112 denote sample-and-hold circuits, and reference numerals 103 and 113 denote hold capacitors. Reference numerals 104 and 114 denote current amplifying circuit, reference numerals 105 and 115 denote reference current sources (constant current circuits), and reference numerals 106 and 116 denote switching circuits. The reference numeral 107 denotes the laser diode, a reference numeral 108 denotes a photodiode, a reference numeral 109 denotes a current-voltage conversion circuit, and the reference numeral 121 denotes the synchronization detection sensor (BD detection element). Note that, the photodiode 108 is referred to as a "PD 108" hereinafter. Furthermore, although described below in detail, a portion including the comparator circuit 101 to the switching circuit 106 corresponds to a first light-intensity controller and a portion including the comparator circuit 111 to the switching circuit 116 corresponds to a second light intensity controller. Note that, although the light intensity controllers are distinguished as the first and second light intensity controllers, correspondence between the portions and the first and second light intensity controllers is not particularly determined. Accordingly, the first and second light intensity controllers may be reversed in a description below, for example.

An engine controller 122 incorporates an ASIC, a CPU, a RAM, and an EEPROM. Furthermore, the engine controller 122 controls not only a printer engine but also communication with a video controller 123.

An OR circuit 124 has an input terminal to which an Ldrv signal and a VIDEO signal are supplied from the engine controller 122 and the video controller 123, respectively. A Data signal is supplied to the switching circuit 106 which will be described hereinafter. Note that the VIDEO signal is based on print data supplied from an external apparatus such as an external reader scanner or a host computer.

The VIDEO signal output from the video controller 123 is supplied to a buffer 125 having an enable terminal and an output from the buffer 125 is supplied to the OR circuit 124. Here, the enable terminal is connected to a line which extends from the engine controller 122 and which supplies a Venb signal.

Furthermore, the engine controller 122 outputs an SH1 signal, an SH2 signal, a BASE signal, the Ldrv signal, and the Venb signal. The Venb signal is used to perform a masking process on the Data signal obtained on the basis of the VIDEO signal. When the Venb signal is brought to a disable state (OFF state), a timing of an image mask region (image mask period) is generated.

First and second reference voltages Vref11 and Vref21 are input to positive terminals of the comparator circuits 101 and 111, respectively, and outputs of the comparator circuits 101 and 111 are supplied to the sample-and-hold circuits 102 and 112, respectively. The reference voltage Vref11 is set as a target voltage used to emit light from the LD 107 in a light emission level for normal printing (first emission level or first light intensity). Furthermore, the reference voltage Vref21 is set as a target voltage used to emit light from the LD 107 in a light emission level for minute emission (second emission level or second light intensity). The hold capacitors 103 and 113 are connected to the sample-and-hold circuits 102 and 112, respectively. Outputs of the hold capacitors 103 and 113 are input to positive terminals of the current amplifying circuits 104 and 114, respectively. Note that, although described below in detail, it is necessarily the case that the reference voltages Vref11 and Vref21 correspond to the light emission level for the normal printing and the light emission level for the minute emission, respectively. The reference voltages Vref11 and Vref21 mean settings for realization of the light emission level for the normal printing and the light emission level for the minute emission in the laser driving system circuit.

The reference current sources 105 and 115 are connected to the current amplifying circuits 104 and 114, respectively, and outputs of the current amplifying circuits 104 and 114 are input to the switching circuits 106 and 116, respectively. On the other hand, third and fourth reference voltages Vref12 and Vref22 are input to negative terminals of the current amplifying circuits 104 and 114, respectively. Here, a current Io1 (first driving current) and a current Io2 (second driving current) are determined in accordance with a difference between a voltage output from the sample-and-hold circuit 102 and the reference voltage Vref12 and a difference between a voltage output from the sample-and-hold circuit 112 and the reference voltage Vref22, respectively. Specifically, the reference voltages Vref12 and Vref22 are set to specify the currents.

The switching circuit 106 turns on or off in accordance with the Data signal serving as a pulse modulation data signal. The switching circuit 116 turns on or off in accordance with an input signal Base.

The switching circuits 106 and 116 have output terminals connected to a cathode of the LD 107 and supplies driving currents Idrv and Ib. The driving current Idrv corresponds to the current Io1 whereas the driving current Ib corresponds to the current Io2. The driving current Idrv is used to realize the light emission level for the normal printing whereas the driving circuit Ib is used to realize the light emission level for the minute emission. Therefore, the driving circuits Idrv and Ib may correspond to the first and second driving currents, respectively. An anode of the LD 107 is connected to a power source Vcc. A cathode of the PD 108 which monitors an intensity of light emitted from the LD 107 is connected to the power source Vcc. An anode of the PD 108 is connected to the current-voltage conversion circuit 109 so that a monitor current Im is supplied to the current-voltage conversion circuit 109. By this, a monitor voltage Vm is generated. The monitor voltage Vm is supplied to negative terminals of the comparator circuits 101 and 111 in a non-feedback manner.

Note that, although the engine controller 122 and the video controller 123 are separately shown in FIG. 3, another configuration may be employed. For example, the engine controller 122 and part of the video controller 123 or the entire video controller 123 may be configured as a single controller. Furthermore, part of the laser driving circuit laser 130 defined by the dotted frame in FIG. 3 or the entire laser driving circuit 130 may be incorporated in the engine controller 122, for example.

Explanation of APC of P(Idrv)

The engine controller 122 sets the sample-and-hold circuit 112 to a hold state (non-sampling period) using the SH2 signal and brings the switching circuit 116 to an off-operation state using the input signal Base. Furthermore, the engine controller 122 sets the sample-and-hold circuit 102 to a sampling state using the SH1 signal and turns the switching circuit 106 on using the Data signal. More specifically, here, the engine controller 122 controls (instructs) the Ldrv signal so that the Data signal causes the LD 107 to be a light emission state. Note that a period in which the sample-and-hold circuit 102 is in the sampling state corresponds to an APC operation state.

In this state, when the LD 107 is brought to a full emission state, the PD 108 monitors an intensity of light emitted from the LD 107 and generates a monitor current Im1 which is proportional to the light emission intensity. Then, by supplying the monitor current Im1 to the current-voltage conversion circuit 109, a monitor voltage Vm1 is generated. Furthermore, the current amplifying circuit 104 controls the driving current Idrv in accordance with the current Io1 supplied to the reference current source 105 so that the monitor voltage Vm1 coincides with the first reference voltage Vref11 which is a target value.

Note that, although described below in detail, when the LD 107 emits light in the light emission level for the normal printing, the circuit shown in FIG. 3 operates as described below. First, the sample-and-hold circuit 112 is set to a hold period, the switching circuit 116 is turned on, and the sample-and-hold circuit 102 is set to a hold period. Then, during non-APC operation, that is, during a normal image forming operation, the sample-and-hold circuit 102 enters a hold period (non-sampling period), the switching circuit 106 is turned on or off in accordance with the Data signal, and pulse width modulation is performed on the driving current Idrv. Accordingly, control of the driving current Idrv (APC operation) described above is performed by controlling a driving current to be superposed on or added to the driving current Ib for the minute emission level.

Explanation of APC of P(Ib)

On the other hand, the engine controller 122 sets the sample-and-hold circuit 102 to a hold state (non-sampling period) using the SH1 signal and brings the switching circuit 106 to an off-operation state using the Data signal. As for the Data signal, the engine controller 122 sets a Venb signal connected to the enable terminal of the buffer 125 to a disable state and controls the Ldrv signal so as to bring the Data signal to an off state. Furthermore, the engine controller 122 sets the sample-and-hold circuit 112 to an APC operation mode using the SH2 signal and turns the switching circuit 116 on using the input signal Base so that the LD 107 is brought to a minute emission state.

In this state, when the LD 107 is brought to the full minute emission state (lighting maintaining state) in which the LD 107 emits weak light, the PD 108 monitors an intensity of light emitted from the LD 107 and generates a monitor current Im2 (Im1>Im2) which is proportional to the intensity of emitted light. Then, the monitor current Im2 is supplied to the current-voltage conversion circuit 109 so that a monitor voltage Vm2 is generated. Furthermore, the current amplifying circuit 114 controls a driving current Ib in accordance with the current Io2 supplied to the reference current source 115 so that the monitor voltage Vm2 coincides with the second reference voltage Vref21 which is a target value.

Then, during a non-APC operation, that is, during a normal image forming operation (in a period in which an image signal is supplied), the sample-and-hold circuit 112 is brought to a hold period (non-sampling period), the full minute emission state which is a weak light state is maintained.

Note that, when ignoring the normal fogging/reversal fogging of the toner, it is preferable that the intensity of emitted laser beam in the minute emission is set to have appropriate intensity to the extent that a charged potential does not become lower than a development potential. However, this is not possible. Specifically, when taking the normal fogging/reversal fogging of the toner into consideration, when an image is formed, an intensity of light of P(Ib) should be normally stable.

Explanation of Minute Emission Level

Figure 4:
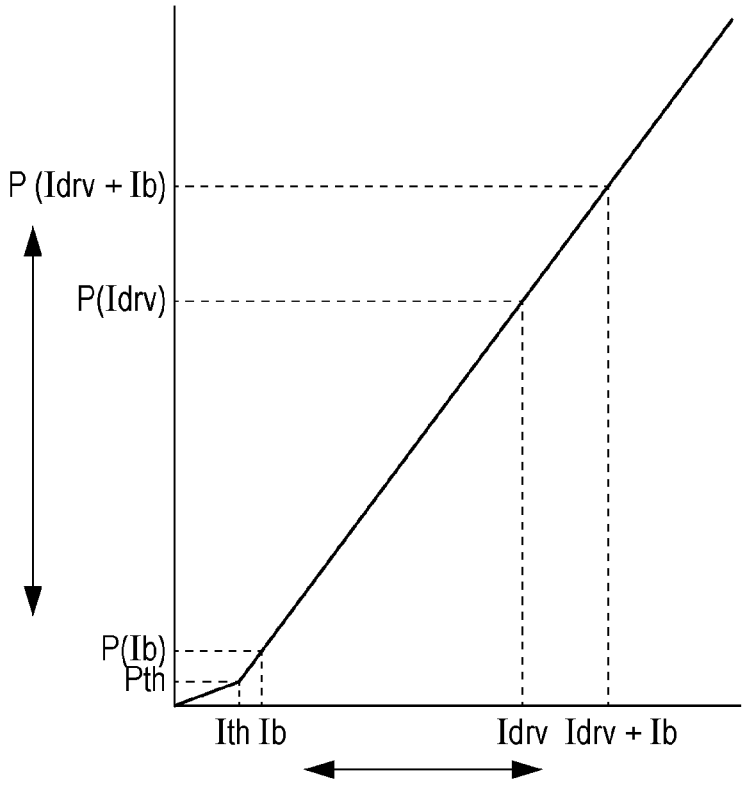
FIG. 4 is a diagram illustrating the relationship between a current supplied to a laser diode and an emission intensity.

In the foregoing description, in the full minute emission state, the driving current Ib is set so as to exceed a threshold value Ith of the LD 107 shown in FIG. 4 and have a minute emission level Pb. Note that the minute emission level represents an emission intensity level set to improve the fogging state of the toner and corresponds to an emission intensity level in which a developer such as the toner is substantially not attached to (developed on) the photoconductor drum in an electrostatic charge manner due to laser irradiation having a certain level. Furthermore, a light emission intensity of the light emission level Pb corresponds to a laser emission region. Here, when the emission level Pb corresponds to an LED emission region which does not satisfy conditions of the laser emission region, distribution of wavelengths of spectra spreads and wavelength distribution larger than distribution of rated laser wavelengths is obtained. Therefore, sensitivity of the photoconductor drum is disturbed and an unstable surface potential is generated. Therefore, the emission level Pb should correspond to the laser emission region which is superior to the LED emission region.

On the other hand, when normal image forming is performed, a driving current (Idrv+Ib) is set to have a light emission level corresponding to intensity of a print level P(Idrv+Ib). Note that the print level means an emission intensity level in which electrostatic attachment of the developer to the photoconductor drum becomes a saturation state.

Figure 5:
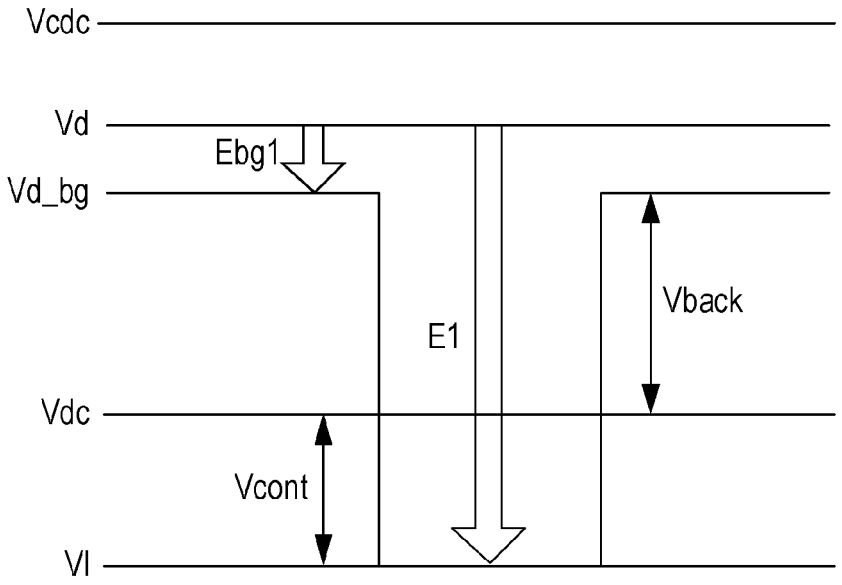
FIG. 5 is a diagram illustrating change of a potential of a photoconductor drum which is associated with minute emission.

The minute emission level will be further described in detail with reference to FIG. 5. A voltage Vcdc applied from a charged high voltage power source (not shown) through the primary charge roller 7 to the photoconductor drum 5 appears on the surface of the photoconductor drum 5 as a charged potential Vd. Specifically, the surface of the photoconductor drum 5 is charged by the potential Vd. Here, the potential Vd is set to be higher than a charged potential obtained in the non-image unit at the time of toner development.

Then, the charged potential Vd is attenuated to a charged potential Vd_bg by laser emission in a minute emission level Ebg1 (second emission level). The attenuation is performed because a potential which is higher than a convergence potential and which is generated in some portions on the surface of the photoconductor drum enhances back contrast Vback and triggers the reversal fogging. Therefore, when the charged potential Vd is attenuated to the charged potential Vd_bg by the laser emission of the minute emission level Ebg1, the potential higher than such a convergence potential is prevented from remaining and at least the occurrence of the reversal fogging is prevented. Furthermore, transfer memory which occurs in the charged potential Vd has been generally known. To address this problem, the transfer memory is made smaller by the laser emission of the minute emission level Ebg1 and at least a ghost image may be prevented from being generated due to the transfer memory.

Furthermore, the laser emission of the minute emission level Ebg1 has a function of correcting the back contrast Vback which is a potential difference with a development potential Vdc. Also from this viewpoint, the normal fogging and the reversal fogging are prevented from being generated. Furthermore, development contrast Vcont(=Vdc−V1) which is a difference value between the development potential Vdc and an exposure potential V1 may be also corrected. By this, deterioration of development efficiency and generation of sweeping may be suppressed and margins for transfer and retransfer may be ensured.

Furthermore, when the charged potential Vd is controlled to be a fixed value, the voltage Vcdc (charged voltage) is set to be variable depending on environment and deterioration (status of use) of the photoconductor drum. Then, in terms of maintenance of image quality, the target intensity of light in the minute emission level (intensity of second emission level) should be set variable in accordance with the variable voltage Vcdc. For example, when a value of the voltage Vcdc becomes large as an integer value (that is, a value of the voltage Vcdc becomes small as an absolute value), an intensity of light in the minute emission level Ebg1 also becomes large whereas when the value of the voltage Vcdc becomes small as an integer value (that is, the value of the voltage Vcdc becomes large), the intensity of light in the minute emission level Ebg1 also becomes small. Note that it is apparent to those who skilled in the art that control of the minute emission level may be achieved by changing the reference voltage Vref21 as described above.

Meanwhile, when the voltage Vcdc is not controlled to a constant value but set as a fixed value, the minute emission level should be controlled as described below. In a case where the voltage Vcdc is a constant value, when deterioration (use status) of the photoconductor drum progresses, for example, the charged potential Vd increases. Therefore, when the charged potential Vd increases, the intensity of light in the minute emission level Ebg1 should be increased. Conversely, the charged potential Vd obtained before the deterioration of the photoconductor drum progresses is smaller than the charged potential Vd obtained after the deterioration progresses. Accordingly, the intensity of light in the minute emission level Ebg1 obtained before the deterioration of the photoconductor drum progresses is smaller than that in the minute emission level Ebg1 obtained after the deterioration of the photoconductor drum progresses. As described above, the emission level for the minute emission (second emission level or second light intensity) may be changed in accordance with change of the charged voltage.

Explanation of P(Ib+Idrv) Emission

When the LD 107 is emitted in the emission level for the normal printing, the circuit shown in FIG. 3 operates as described below. Specifically, the sample-and-hold circuit 112 is set to a hold period, the switching circuit 116 is turned on, the sample-and-hold circuit 102 is set to a hold period, and the switching circuit 106 is turned on. That is, in the laser driving system circuit shown in FIG. 3 and a laser driving system circuit shown in FIG. 6 which will be described hereinafter, the LD 107 is emitted in the emission level for the normal printing by adding a driving current Idrb to the driving current Ib. By this, a driving current (Idrv+Ib) is supplied. Furthermore, the LD 107 may be set so as to have an emission intensity in the minute emission level Pb of the driving current Ib while the switching circuit 106 is in an off state.

Although described below in detail, the print level P(Idrv+Ib) corresponds to an intensity of emission (emission intensity) obtained by superposing a PWM emission level P(Idrv) obtained by pulse width modulation on the minute emission level Pb. More specifically, in a state in which the SH2 signal, the SH1 signal, and the Base signal are set as described above and in a state in which the engine controller 122 brings the Venb signal to an enable state, the switching circuit 106 is turned on or off using the Data signal (VIDEO signal). By this, two-level emission including emission by the driving current Ib and emission by the driving current (Idrv+Ib), that is, emission with the emission intensity P(Ib) and emission with an emission intensity P(Idrv+Ib) may be performed. Furthermore, as for an intensity of light corresponding to the emission intensity P(Idrv+Ib), laser emission in a period of time corresponding to a pulse duty is performed on the basis of the emission intensity P(Ib).

As described above, by driving the circuit shown in FIG. 3, the engine controller 122 performs the APC on the LD 107 in the minute emission level so as to cause the LD 107 to emit light in the minute emission level P(Ib). Furthermore, using the Data signal obtained on the basis of the VIDEO signal supplied from the video controller 123, light emission in the print level P(Idrv+b) which is a first level may be performed in the laser emission region and operations in two emission levels may be performed.

Diagram of Another Laser Driving System Circuit

Figure 6:
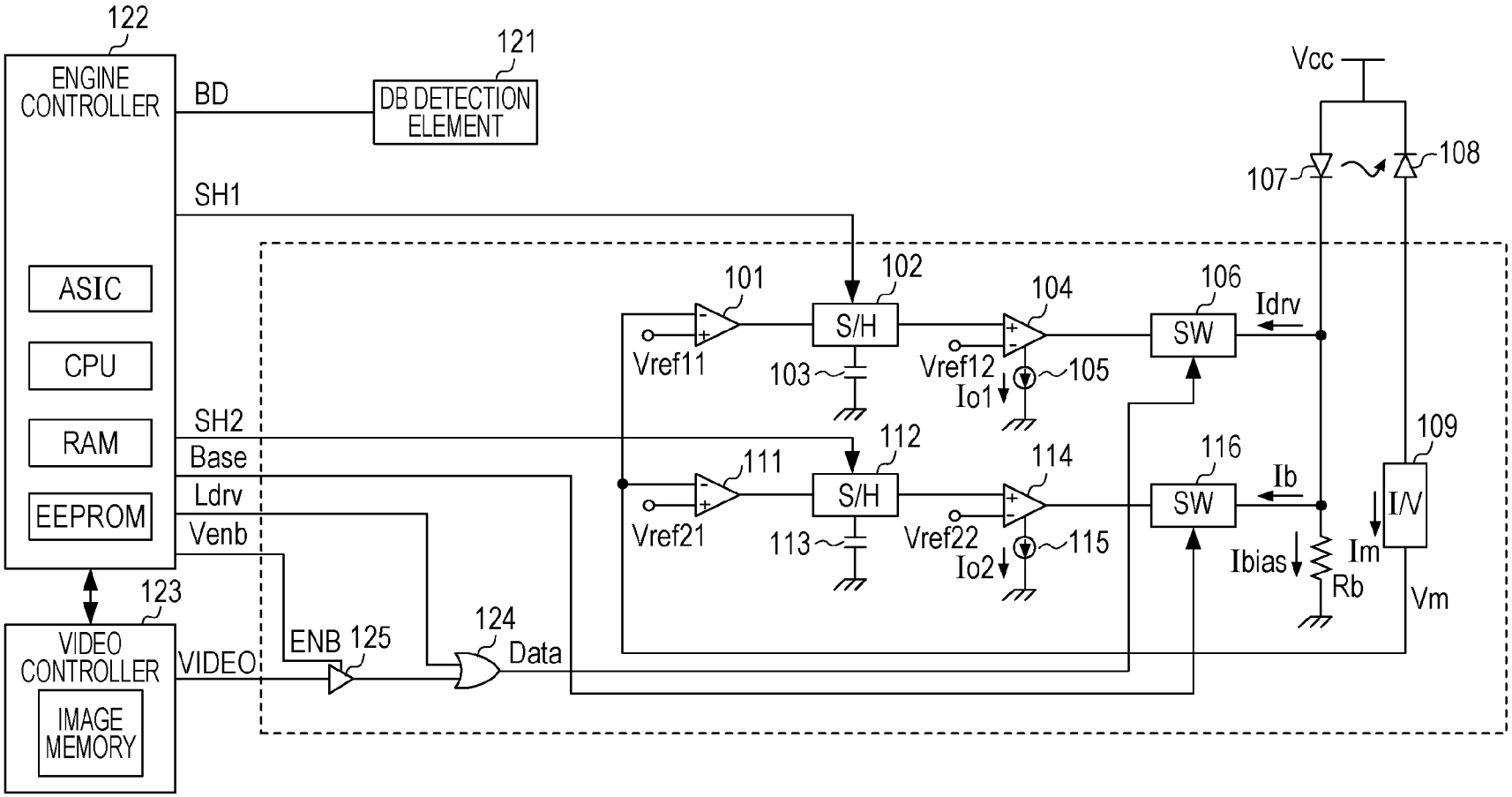
FIG. 6 is a diagram illustrating another laser driving circuit including a two-level light intensity control function.
Figure 7:
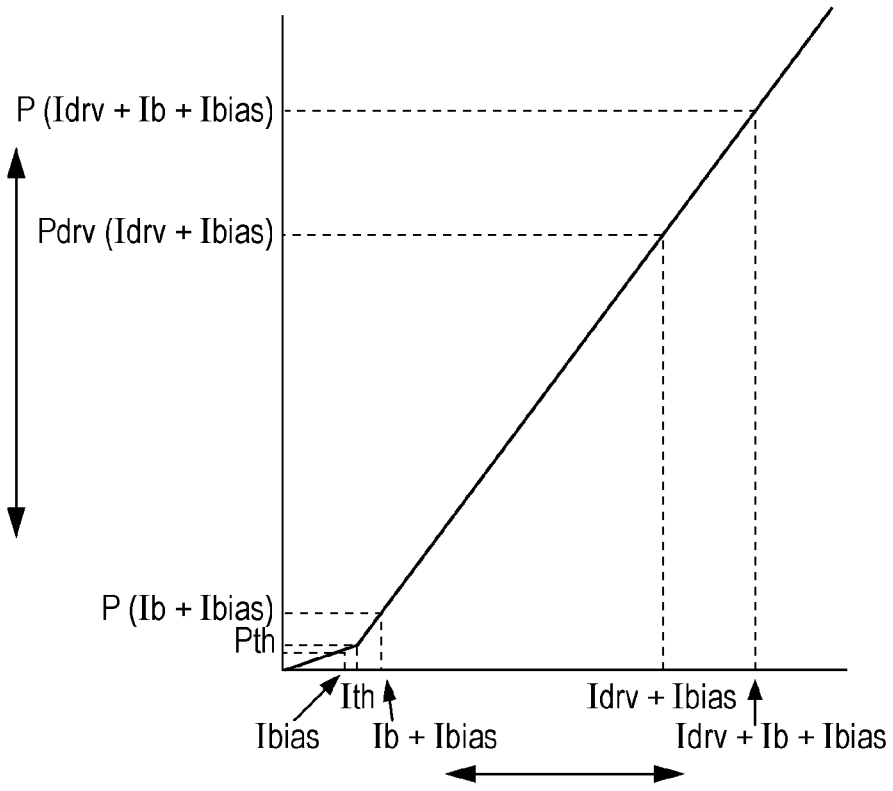
FIG. 7 is a diagram illustrating the relationship between a current supplied to a laser diode and an emission intensity.

The circuit shown in FIG. 6 is different from that shown in FIG. 3 in that a resistor Rb which supplies a bias current Ibias is additionally provided. The bias current Ibias is set so as to be smaller than the threshold value Ith of the LD 107 in a range out of the laser emission region (which is referred to as a "normal LED emission region"). The relationships between laser emission intensities and current values will be shown in FIG. 7. A bias current is effective for improvement of a rising characteristic of the LD 107 as disclosed in various documents.

In the circuit shown in FIG. 6, the sample-and-hold circuit 112 is brought to a hold state using the SH2 signal and the switching circuit 116 is turned on whereby a driving current (Ib+Ibias) is supplied to the LD 107. In the circuit shown in FIG. 6, the LD 107 emits light with an emission intensity P (Ib+Ibias) in the minute emission level. Here, the emission intensity P (Ib+Ibias) in the minute emission level corresponds to the laser emission region. Furthermore, the sample-and-hold circuit 102 is set to a hold period using the SH1 signal and the switching circuit 106 is turned on using the Data signal so that the driving current Idrv is also supplied. As with the case of FIG. 3, the driving current Idrv is superposed or added to the driving current corresponding to the minute emission level. By this, a driving current (Idrv+Ib+Ibias) is supplied in total and light emission in an emission level P(Idrv+Ib+Ibias) for normal printing is performed.

As described above, the LD 107 emits light by changing an emission intensity between an emission intensity in the print level P(Idrv+Ib+Ibias) and an emission intensity in the minute emission level P(Ib+Ibias) corresponding to the driving current (Ib+Ibias). More specifically, in a state in which the SH2 signal, the SH1 signal, and the Base signal are set as described above and in a state in which the engine controller 122 brings the Venb signal to an enable state, the switching circuit 106 is turned on or off using the Data signal based on the VIDEO signal. By this, PWM laser emission in two-level emission state including emission by the driving current (Ib+Ibias) and emission by the driving current (Idrv+Ib+Ibias), that is, emission with the emission intensity P(Ib+Ibias) and emission with an emission intensity P(Idrv+Ib+Ibias) may be performed.

Two-Level APC Sequence

Figure 8:
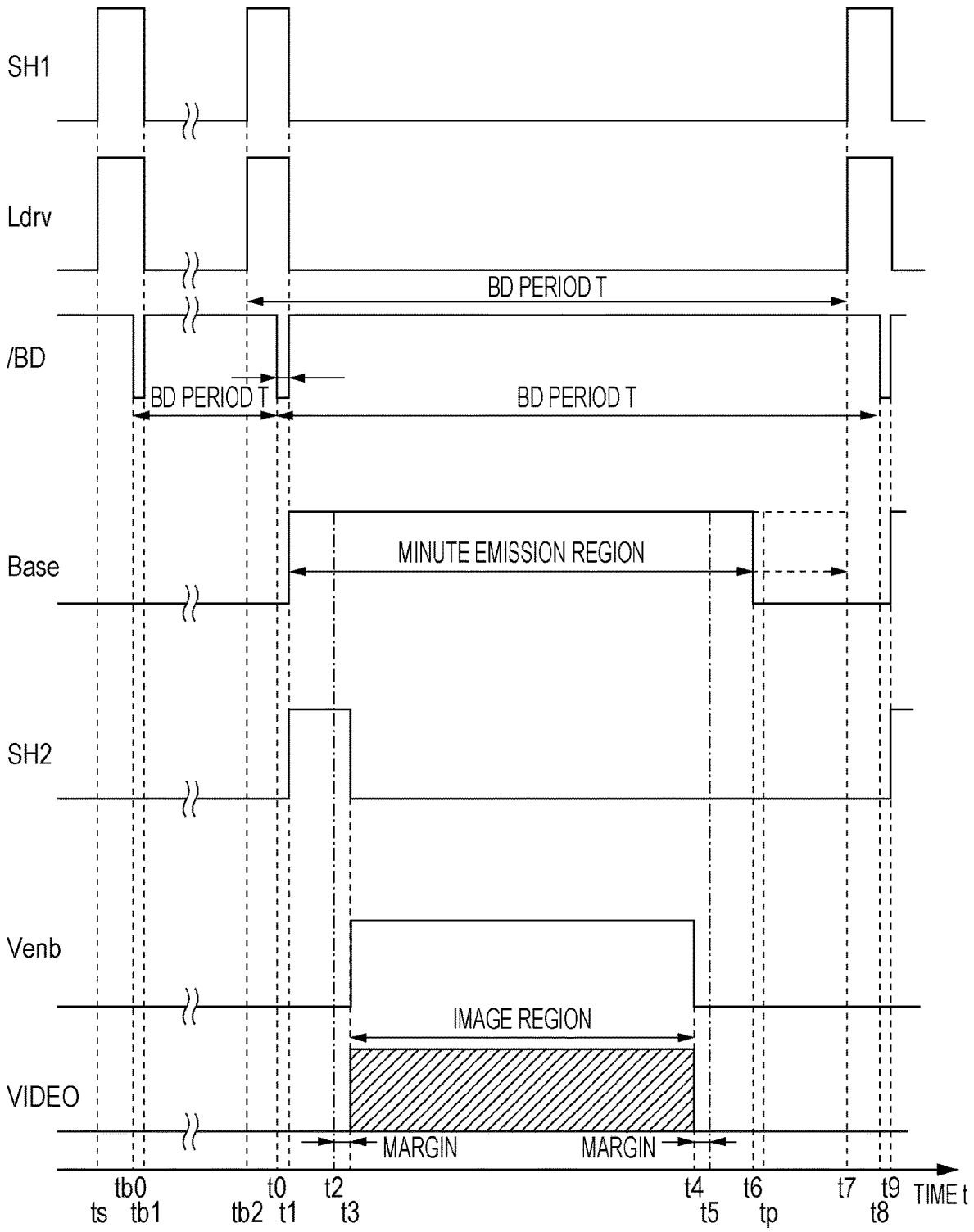
FIG. 8 is a timing chart relating to automatic light intensity control.

Next, a timing when the APC is executed to maintain a laser emission level will be described. FIG. 8 is a timing chart of laser scanning.

First, at a timing ts, the engine controller 122 turns the SH1 signal and the Ldrv signal on so as to turn the switching circuit 106 on. Note that the term "timing ts" and the like terms are simply referred to as "ts" and the like hereinafter.

Then, a signal output from the synchronization detection sensor 121 is supplied as a horizontal synchronization signal /BD at tb0. When the engine controller 122 detects the horizontal synchronization signal /BD at tb0, the engine controller 122 turns the SH1 signal and the Ldrv signal off at tb1 so as to turn the switching circuit 106 off. By this, the APC for the normal printing level is terminated. Then, after the APC in the print level is terminated, the LD 107 emits a laser beam in the normal print level in accordance with the VIDEO signal. Then, the laser emission is performed in accordance with the VIDEO signal between tb1 and tb2, and a detailed description of this laser emission is omitted.

Next, the engine controller 122 controls the current Io1 (first driving current) with reference to a timing (detection timing) in which the horizontal synchronization signal /BD is output in accordance with a preceding scanning line. More specifically, with reference to the timing (tb0 or tb1) in which the horizontal synchronization signal /BD is output, the SH1 signal and the Ldrv signal are turned on so that the switching circuit 106 is turned on at tb2 which is a timing after predetermined period of time has been elapsed (before the next horizontal synchronization signal /BD is detected). Thereafter, the APC in the print level is started again. Furthermore, before the APC is started, the engine controller 122 turns the Venb signal off and issues a disable instruction to the enable terminal of the buffer 125. Furthermore, the disable instruction is similarly input in APC which is performed immediately before this APC. Then, by this, even when the video controller 123 outputs a signal in error (including noise), a control instruction which is associated with the APC and which is issued from the engine controller 122 may be reflected to the control.

Then, another signal is output from the synchronization detection sensor 121 as a horizontal synchronization signal /BD at t0. When the engine controller 122 detects the horizontal synchronization signal /BD at t0, the SH1 signal and the Ldrv signal are turned off at t1 so as to turn the switching circuit 106 off whereby the APC in the print level is terminated again.

Subsequently, the engine controller 122 turns the SH2 signal and BASE signal on at t1 after detection of the horizontal synchronization signal /BD so as to turn the switching circuit 116 on. By this, the engine controller 122 starts APC in the minute emission level. Note that the APC in the minute emission level may be started at any timing between t1 and t2. The APC in the minute emission level should be performed at least part of an image masking period between t1 to t2. In particular, when the APC in the minute emission level is executed in a margin period from t2 to t3, excellent efficiency is attained.

Then, the engine controller 122 maintains the SH2 signal to be on state until t3. Specifically, the APC in the minute emission level is continued until t3. Accordingly, a long period of the APC in the minute emission level is ensured.

Figure 9A:
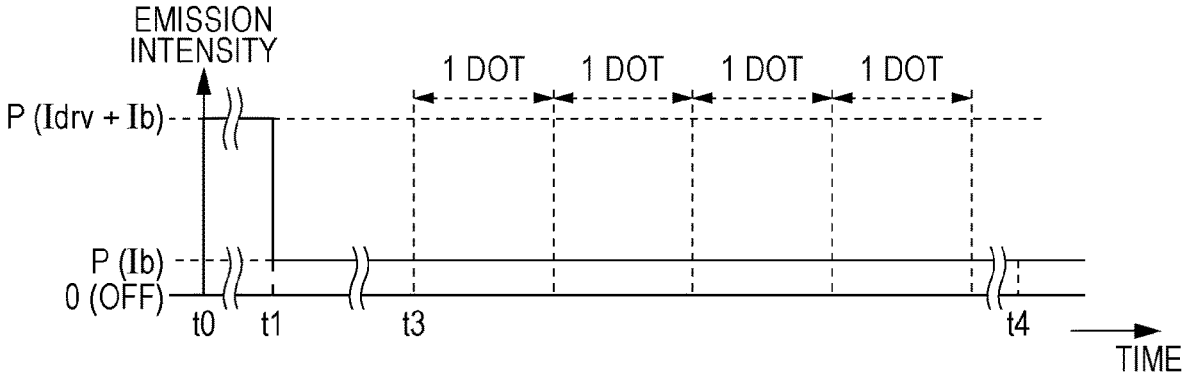
FIGS. 9A to 9C are diagrams illustrating the relationships between the minute emission and PWM emission.
Figure 9B:
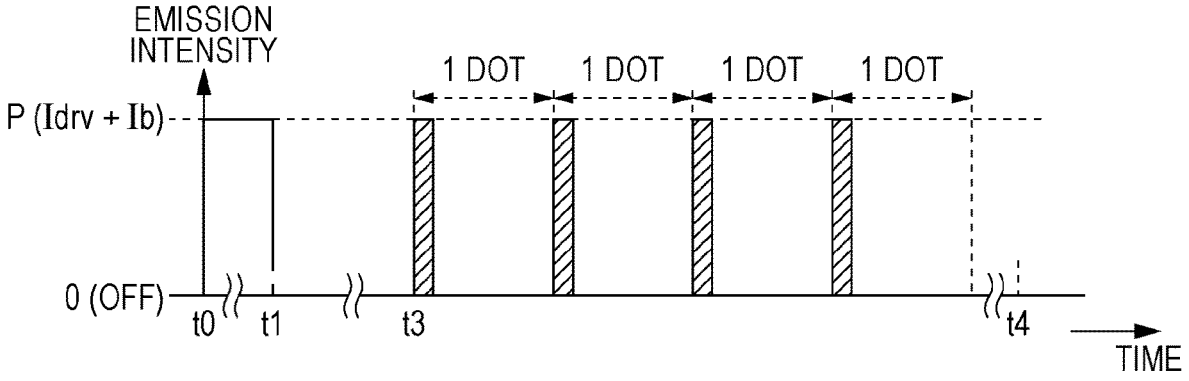

Here, FIG. 9A shows transition of an emission intensity of the LD 107 in this state. Furthermore, FIG. 9B shows transition of an emission intensity of the LD 107 in the minute emission level in a general PWM method. In the minute emission in the general PWM method, light emission in the print level P(Idrv+Ib) is performed in a predetermined ratio (a minute pulse width corresponding to a minute emission intensity) for each pixel in the non-image section in synchronization with an image clock having a fixed frequency so that an intensity of light corresponding to the minute emission level is realized. On the other hand, in this embodiment, an intensity of emission light in the minute emission level is obtained by constantly continuing light emission in the minute emission level Pb.

Here, a sheet-end timing corresponds to t2, and the relationship "t1<t2<t3" is satisfied. Furthermore, in a case of so-called borderless print, since an image region exceeds a sheet-end portion, the relationship "t1<t3<t2" is satisfied. Note that the period from t2 to t3 is referred to as a margin region interval or a margin region period since laser emission corresponding to a margin region in a recording sheet is performed. Furthermore, a period from t4 to t5 which will be described hereinafter may be similarly referred to.

As described above, although automatic light intensity control of laser beams is performed in the non-image region (out of effective regions of the photoconductor drum) such as a region between scanning lines, when miniaturization of image forming apparatuses and optical scanning apparatuses progresses, a ratio of an image region for one scanning operation in the optical scanning apparatuses becomes large, and accordingly, a time ratio of the non-image region is reduced. Even in such a case, according to the timing chart shown in FIG. 8, since the automatic light intensity control executed when the SH2 signal is valid is executed after the horizontal synchronization signal /BD is output, the automatic light intensity control may be continued through a timing when laser scanning has reached the margin portion of the sheet.

Returning back to the description with reference to FIG. 8, the engine controller 122 issues an instruction for outputting an enable signal to the enable terminal of the buffer 125 using the Venb signal at t3 which is a timing after a predetermined period of time has been elapsed with reference to a timing (t0 or t1) when the horizontal synchronization signal /BD is output. By this, the image masking is cancelled. Furthermore, in response to the instruction for outputting the enable signal issued to the enable terminal, the video controller 123 outputs the VIDEO signal at t3 which is the timing after the predetermined period of time has been elapsed with reference to the timing (t0 or t1) when the horizontal synchronization signal /BD is output. Then, the LD 107 performs laser emission in the print emission level P(Ib+Idrv) and the optical scanning apparatus described with reference to FIG. 2 performs laser scanning.

Note that a minute emission region in which light is emitted by an emission intensity corresponding to the minute emission level is larger than the largest image region which is scanned by the VIDEO signal and the minute emission is performed in a region larger than an interval between the sheet end timings. Furthermore, the minute emission is performed in the non-image section included in the region of the VIDEO signal.

Figure 9C:
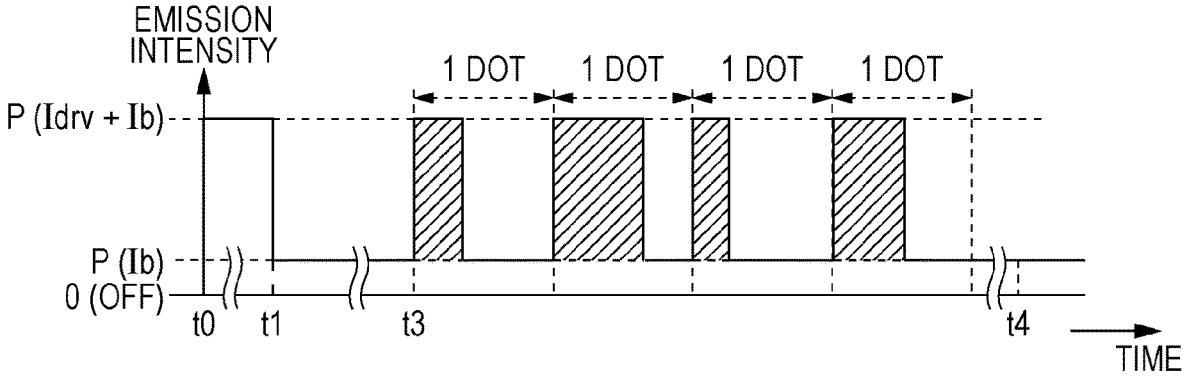
Figure 10A:
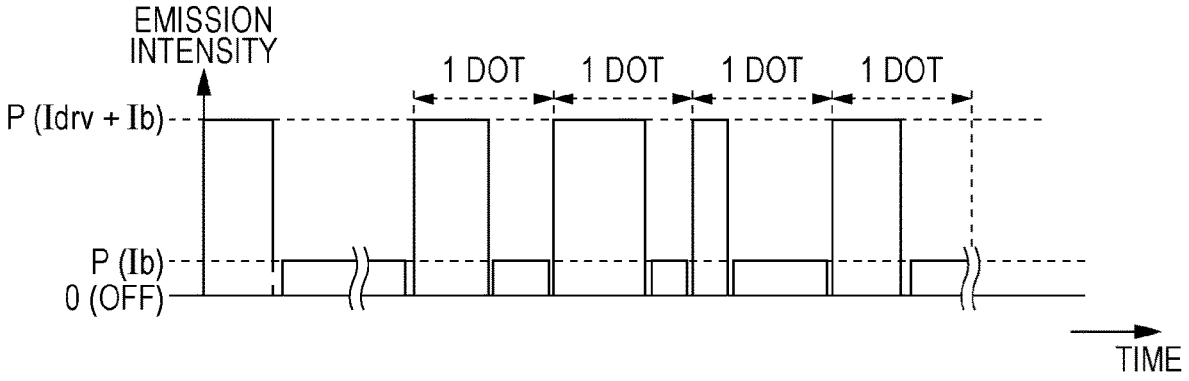
FIGS. 10A and 10B are diagrams illustrating occurrence of image defect and destroy of an light emitting element.
Figure 10B:
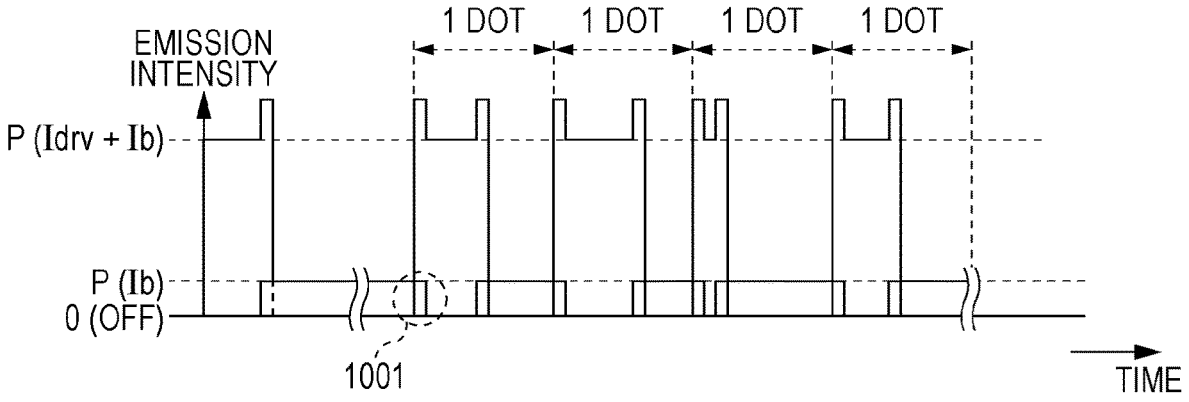

FIG. 9C is a diagram illustrating a state in which the LD 107 emits light when the video controller 123 outputs the VIDEO signal. In the general PWM method, an intensity of emission in the print level P(Idrv+Ib) is added to the intensity of emission in the minute emission level in a pixel described with reference to FIG. 9A. On the other hand, in this embodiment, PWM emission obtained by pulse width modulation is superposed on the minute emission level Pb of constant emission light. Hatched portions shown in FIG. 9C represent an intensity of emission in the print level. According to FIG. 9C, generated radiation noise may be suppressed to a low level when compared with the case where the PWM method is employed for the minute emission as shown in FIG. 9B. Furthermore, when the circuit operates as shown in FIG. 9C, the following advantage is obtained. Specifically, in addition to the operations described with reference to FIGS. 3 and 6, an operation of supplying a current to the LD 107 by performing switching between the driving current Ib and the driving current (Ib+Idrv), for example, may be employed. However, in this case, the following disadvantage is obtained. For example, as shown in FIG. 10A, when a timing when stop of supply of the driving current Ib is earlier than expected or a timing when start of supply of the driving current (Ib+Idrv) is later than expected, a gap period in which laser emission is not performed is generated, and accordingly, image defect occurs. Furthermore, as denoted by a dotted circle 1001 shown in FIG. 10B, when the supply of the driving current Ib overlaps with the supply of the driving current (Ib+Idrv), an excessive driving current is supplied to the LD 107 in the overlapping period. This causes short life or destroy of the light emitting element (LD 107). On the other hand, in the operation shown in FIG. 9C, occurrence of such a problem may be prevented.

Referring back to the explanation of the timing chart shown in FIG. 8, the video controller 123 scans the image region of the photoconductor drum for dots of the laser beam in accordance with the VIDEO signal until t4 which is a timing reached after a predetermined period of time has been elapsed with reference to the timing (t0 or t1) when the horizontal synchronization signal /BD is output. The period from t3 to t4 corresponds to an emission period in which the LD 107 performs laser emission on a toner image forming region (latent image forming region).

Simultaneously, the engine controller 122 inputs an instruction for outputting a disable signal to the enable terminal of the buffer 125 using the Venb signal at t4 which is a timing after a predetermined period of time has been elapsed with reference to the timing (t0 or t1) when the horizontal synchronization signal /BD is output. By this, a image masking cancelling period is terminated. In other words, periods other than the image masking cancelling period correspond to the image masking period.

Furthermore, the engine controller 122 turns the switching circuit 116 off using the BASE signal at t6 which is a timing after a predetermined period of time has been elapsed with reference to the timing (t0 or t1) when the horizontal synchronization signal /BD is output whereby the minute emission is terminated.

Here, a sheet-end timing corresponds to t5, and the relationship "t4<t5<t6" is satisfied. Note that the sheet-end timing represents a timing when the LD 107 performs laser irradiation to positions of the belt (intermediate transfer belt) corresponding to edges of sides which are orthogonal to a conveying direction of the recording sheet. Furthermore, in a case of a so-called borderless print, the relationship "t5<t4<t6" is satisfied. Although the timing t6 when the minute emission is terminated comes before a polygon-end timing tp in this embodiment, the minute emission may be continued until t7.

In this way, the automatic light intensity control may be performed in the minute emission level in a region (from t1 to t6) which is larger than the image region (from t3 to t4) and larger than the region between sheet ends (from t2 to t5).

Furthermore, the engine controller 122 performs again the process performed after tb2 from t7 which comes after a predetermined period of time has been elapsed with reference to the timing (t0 or t1) when the horizontal synchronization signal /BD is output. In this way, various types of APC may be efficiently performed several times when a print job is executed in response to a print request externally supplied. Note that, as for a frequency of execution of the APC, the APC may be performed for each laser scanning, for each page (only first scanning in each page), or for every predetermined number (2 or more) of laser scanning.

As described above, according to the timing chart shown in FIG. 8, the following advantage may be obtained. In the light emission in the minute emission (non-image-section minute emission) level, as described above, a developer such as a toner is not electrostatically charged and attached to a photoconductor drum by laser irradiation. Therefore, an emission intensity setting in the minute emission (non-image-section minute emission) level may be performed in the non-image region including an effective image region of the photoconductor drum (before the image region). Accordingly, even when the non-image region which is out of the effective image region of the photoconductor drum becomes small due to miniaturization of a body and miniaturization of the optical scanning apparatus, a long APC period in the two levels may be ensured. Then, since the timing chart shown in FIG. 8 is executed several times in one job, the intensity of light of the minute emission may be controlled several times in one job and the charged potential Vd may be appropriately maintained through one job. Consequently, occurrence of reversal fogging and normal fogging may be suppressed.

Note that, although the minute emission level P(Ib) and the print level P(Idrv+Ib) have been described in the timing chart shown in FIG. 8, when the minute emission level P(Ib) and the print level P(Idrv+Ib) may be replaced by the minute emission level P(Ib+Ibias) and the print level P(Idrv+Ib+Ibias), respectively, the same advantages may be obtained in the circuit shown in FIG. 6.

Second Embodiment

In a second embodiment, the first embodiment is further expanded and a longer period of time is assigned to two-level APC. Note that a configuration of an image forming apparatus and a configuration of a circuit are basically the same as those described in the first embodiment, and therefore, detailed descriptions thereof are omitted. Furthermore, although a timing chart of APC according to the second embodiment will be described with reference to FIG. 11 hereinafter, a process the same as that in the first embodiment is performed until a timing t6, and therefore, a description thereof is also omitted. Different points will be mainly described hereinafter.

Figure 11:
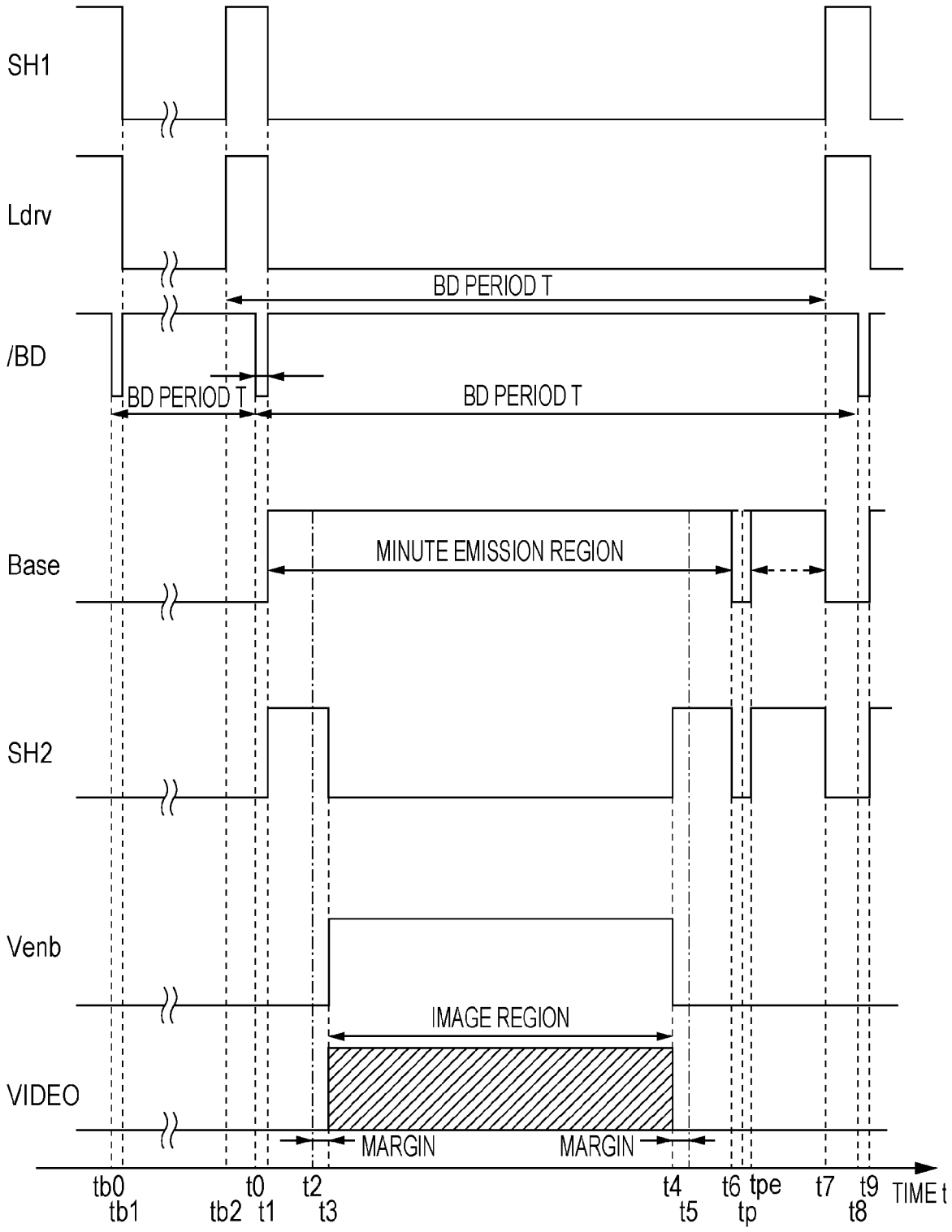
FIG. 11 is another timing chart relating to automatic light intensity control.
Figure 12:
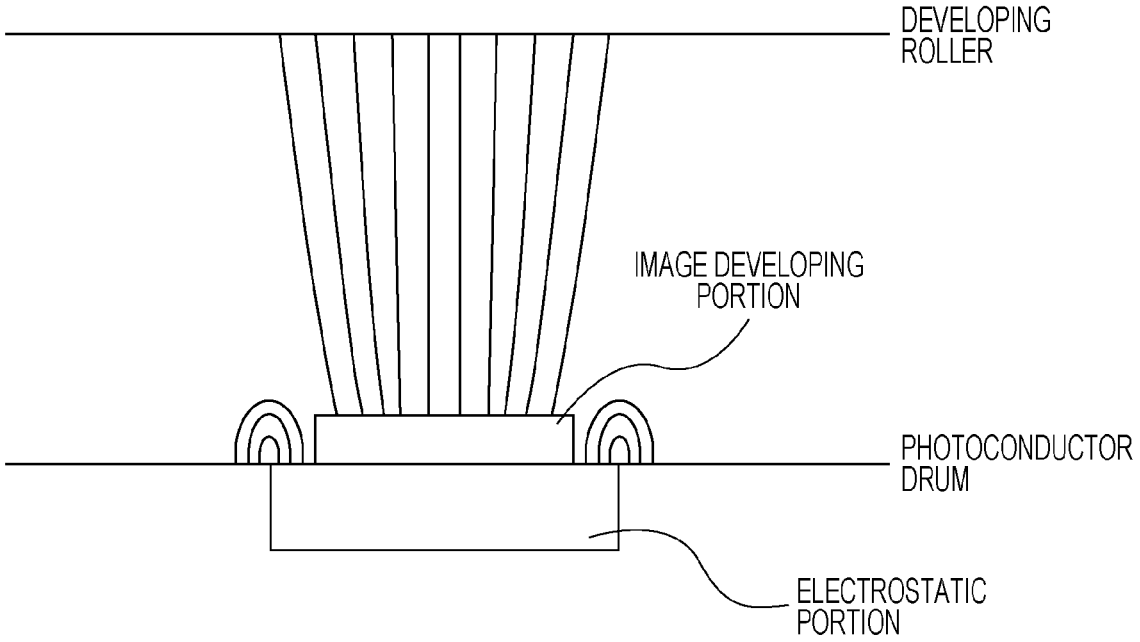
FIG. 12 is a diagram used to describe a white gap.

FIG. 11 is a timing chart illustrating timings of optical scanning according to the second embodiment. As striking feature of this embodiment, an emission intensity setting in a minute emission (non-image-section minute emission) level is performed also at a timing in a non-image region including an effective image region of a photoconductor drum (before image region).

Specifically, a video controller 123 scans an image region on the photoconductor drum for dots of a laser beam until t4 which is a timing after a predetermined period of time has been elapsed with reference to a timing (t0 or t1) when a horizontal synchronization signal /BD is output and then terminates the image scanning. A period from t3 to t4 corresponds to an emission period in which an LD 107 performs laser emission on a toner image forming region (latent image forming region).

Simultaneously, an engine controller 122 inputs an instruction for outputting a disable signal to an enable terminal of a buffer 125 using a Venb signal at t4 which is a timing after a predetermined period of time has been elapsed with reference to the timing (t0 or t1) when the horizontal synchronization signal /BD is output.

Furthermore, the engine controller 122 starts APC in a minute emission level by turning an SH2 signal on at t4 after the predetermined period of time has been elapsed with reference to the timing (t0 or t1) when the horizontal synchronization signal /BD is output.

Then, the engine controller 122 maintains the SH2 signal to be an on state until t6 so that the APC in the minute emission level is continued. Then, the engine controller 122 turns the SH2 signal off and turns the switching circuit 116 off using the Base signal at t6 so that the APC in the minute emission level is terminated. It is assumed that a timing tp when a face of a polygon mirror is changed is included in a forcible emission period of automatic light intensity control. At this timing (from t6 to tpe), the laser emission is stopped to avoid generation of stray light and the like caused by reflection in edge portions of a polygon.

Furthermore, the engine controller 122 starts the APC in the minute emission level again by turning the SH2 signal on at tpe after a predetermined period of time has been elapsed with reference to the timing (t0 or t1) when the horizontal synchronization signal /BD is output.

Then, the engine controller 122 maintains the SH2 signal to be an on state until t7 so that the APC in the minute emission level is continued. Then, the engine controller 122 turns the SH2 signal off and turns the switching circuit 116 off using the Base signal at t7 so that the APC in the minute emission level is terminated.

Furthermore, the engine controller 122 starts APC in a printing level by turning an SH1 signal on and turning a switching circuit 106 on using an Ldrv signal at t7 after a predetermined period of time has been elapsed with reference to the timing (t0 or t1) when the horizontal synchronization signal /BD is output.

Then, a signal output from a synchronization detection sensor 121 is supplied as a horizontal synchronization signal /BD at t8. When detecting the horizontal synchronization signal /BD at t8, the engine controller 122 performs again the sequence starting from t0 described hereinabove.

As described above, in the second embodiment, in addition to the advantages of the first embodiment, the following advantage is obtained. Specifically, the emission intensity setting in the minute emission level may be performed in a period from a sheet margin section t4 which is a timing of the non-image region including the effective image region of the photoconductor drum (after the image region) to a timing t7 when an emission intensity setting in a normal emission level is started. Accordingly, a longer period of the automatic light intensity control in the minute emission level is ensured.

Note that, although the minute emission level P(Ib) and the print level P(Idrv+Ib) have been described in the timing chart shown in FIG. 11, when the minute emission level P(Ib) and the print level P(Idrv+Ib) may be replaced by a minute emission level P(Ib+Ibias) and a print level P(Idrv+Ib+Ibias), respectively, the same advantages may be obtained in the circuit shown in FIG. 6.

Third Embodiment

In the foregoing embodiments, the APC in the PWM emission level P(Idrv) and the APC in the minute emission level P(Ib) have been described. However, the APC in the minute emission level P(Ib) may be performed first so that APC in the print emission level P(Ib+Idrv) is performed.

Specifically, the APC in the minute emission level P(Ib) according to the first embodiment is executed first. Thereafter, the engine controller 122 sets a sample-and-hold circuit 112 to a hold state using an SH2 signal and turns a switching circuit 116 on using an input signal Base. That is, the LD 107 is brought to a bias emission (laser emission region) state.

Simultaneously, as with the foregoing embodiments, the engine controller 122 sets a sample-and-hold circuit 102 to a sampling state and turns a switching circuit 106 on using a Data signal so that the LD 107 performs full emission.

In the state in which the LD 107 is in a full emission state, a PD 108 monitors an intensity of light emitted from the LD 107. Furthermore, the PD 108 generates a monitor current Im1' which is proportional to the actual emission intensity and supplies the monitor current Im1' to the current-voltage conversion circuit 109 so that a monitor voltage Vm1' is generated.

A current amplifying circuit 104 controls a driving current Idrv' in accordance with a current Io1' supplied to a reference current source 105 so that the monitor voltage Vm1' coincides with a first reference voltage Vref11' which is a target value. Here, the reference voltage Vref11' has a value corresponding to the print emission level P(Ib+Idrv). In addition, the driving current Idrv' represents a difference between a current which emits light having an intensity corresponding to the print emission level P(Ib+Idrv) and a current which emits light having an intensity corresponding to the minute emission level P(Ib).

Furthermore, as for an executing timing, the APC in the print emission level P(Ib+Idrv) may be executed at a timing when the APC in the PWM emission level P(Idrv) is performed. Furthermore, the APC in the minute emission level P(Ib) should be performed before the APC in the print emission level P(Ib+Idrv) is performed and may be performed before forcible emission when a horizontal synchronization signal /BD is detected. Furthermore, although the minute emission level P(Ib) and the print level P(Idrv+Ib) have been described in the foregoing description, the minute emission level P(Ib) and the print level P(Idrv+Ib) may be replaced by the minute emission level P(Ib+Ibias) and the print level P(Idrv+Ib+Ibias), respectively. In this case, the same advantages may be obtained in the circuit shown in FIG. 6.

Modifications

In the first embodiment, the APC in the PWM emission level P(Idrv) and the APC in the minute emission level P(Ib) are separately executed. However, the present invention is not limited to this. For example, APC in a print emission level P(Ib+Idrv) may be performed instead of the APC in the minute emission level P(Ib).

Specifically, after APC in a PWM emission level P(Idrv) is executed, a sample-and-hold circuit 102 is brought to a hold period (non-sampling period) using an SH1 signal in accordance with an instruction issued by an engine controller 122 and a switching circuit 106 is turned on. Furthermore, a sample-and-hold circuit 112 is brought to an APC operation state using an SH2 signal and a switching circuit 116 is turned on using an input signal Base.

In the state in which a LD 107 is in a full emission state, a PD 108 monitors an intensity of light emitted from the LD 107. Then, a monitor current Im2' which is proportional to the actual emission intensity is generated (Im1<Im2') and the monitor current Im2' is supplied to a current-voltage conversion circuit 109 so that a monitor voltage Vm2' is generated.

Furthermore, a current amplifying circuit 114 controls a driving current Ib in accordance with a current Io2' supplied to a reference current source 115 so that the monitor voltage Vm2' corresponds to a voltage Vref21' having a potential corresponding to a sum of first and second reference voltages which are target values. Then, the SH2 signal is turned off and the sample-and-hold circuit 112 is brought to a hold state, a voltage corresponding to a driving current Ib is charged to a capacitor 113. Thereafter, after a non-APC operation state is entered, that is, the sample-and-hold circuit 112 is brought to the hold state (non-sampling period), when the Base signal is an on state, a full emission state in which emission is performed by an intensity of light corresponding to the driving current Ib is entered.

Furthermore, the following modification may be employed. For example, an automatic light intensity control circuit including components the same as the comparator circuit 101 to the switching circuit 106 which are described above is additionally provided, for example.

When the components are added, outputs of switching circuits are connected to immediately below a LD 107 and a negative terminal of a comparator circuit corresponding to the comparator circuit 101 is connected to a current-voltage conversion circuit 109. Then, a voltage value corresponding to the driving current (Idrv+Ib) in the foregoing embodiments is set as a reference voltage Vref01 to the negative terminal of the comparator circuit corresponding to the comparator circuit 101 in advance. Furthermore, here, the engine controller 122 turns the input signal Base and the Ldrv signal off. Note that the sampling described here may be performed between tb2 to t1 shown in FIG. 8, for example.

Then, the output of the sample-and-hold circuit (output of the hold capacitor) is supplied to the engine controller 122 through an A/D port, not shown, and temporarily stores the output in a RAM as a driving current (VIdrv+Ib).

Subsequently, the engine controller 122 turns a switching circuit of the added automatic light intensity control circuit and the switching circuit 116 off and the APC in the PWM emission level P(Idrv) according to the first and second embodiments is performed. Detailed operation has been described hereinabove. Then, the output of the sample-and-hold circuit 102 (output of the hold capacitor) is supplied to the A/D port, not shown, and is temporarily stored in the RAM as a driving current VIdrv.

A CPU included in the engine controller 122 obtains a driving current VIb using a difference between the currents (VIdrv+Ib) and VIdrv stored in the RAM and inputs (sets) the obtained voltage value to a positive terminal of the current amplifying circuit 114 through a D/A port, not shown. Note that the sampling described here may be performed between t1 to the sheet edge timing t2 shown in FIG. 8, for example. Furthermore, in this case, the comparator circuit 111 and the sample-and-hold circuit 112 are substantially not required.

As described above, according to the modifications described above, the automatic light intensity control may be performed by not only a direct method such as those described in the first and second embodiments but also an indirect method. Furthermore, although the minute emission level P(Ib) and the print level P(Idrv+Ib) have been described in the foregoing description, the minute emission level P(Ib) and the print level P(Idrv+Ib) may be replaced by the minute emission level P(Ib+Ibias) and the print level P(Idrv+Ib+Ibias), respectively. Also in this case, the same advantages may be obtained in the circuit shown in FIG. 6.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus, comprising:

a photoconductor drum;

a charging unit configured to charge the photoconductor drum;

a light emitting element configured to operate in at least a laser emission operating region, the light emitting element radiating light on the charged photoconductor drum to form a latent image, wherein the latent image becomes visible when toner attaches to the photoconductor drum;

a first light-intensity controller configured to adjust, in a state where a first driving current added with a second driving current smaller than the first driving current and a third driving current smaller than a current required for the light emitting element to emit a laser beam is supplied to the light emitting element, the first driving current such that an emission level of the light emitted from the light emitting element is a first emission level; and a second light-intensity controller configured to adjust, in a state where the second driving current added with the third driving current but without the first driving current is supplied to the light emitting element, the second driving current such that the emission level of the light emitted from the light emitting element is a second emission level smaller than the first emission level;

a switching unit operative to add the first driving current to the second driving current, and the first light-intensity controller being configured to adjust the first driving current such that the first driving current added with the second driving current causes the light emitting element to emit light with the intensity at the first emission level for forming the latent image on an image section in an image region, the switching unit being further configured to switch off the first driving current to cause the light emitting element to be driven by the second driving current, so as to emit light with the intensity at the second emission level for a non-image section in the image region.

2. The image forming apparatus according to claim 1, wherein the switching unit comprises a first switch controlling on and off status of the first driving current and a second switch controlling on and off status of the second driving current.

3. The image forming apparatus according to claim 1, wherein the switching unit is further configured to cause the light emitting element to emit light with the intensity at the first emission level for printing the image section on the latent image for a period of time corresponding to a pulse duty.

4. The image forming apparatus according to claim 1, wherein the switching unit is configured to switch off the first driving current independently from an output of the first light-intensity controller to cause the light emitting element to be driven by the second driving current, so as to emit light with the intensity at the second emission level.

5. The image forming apparatus according to claim 1, wherein the switching unit is operative to add the first driving current to the second driving current based on a VIDEO signal output based on print data supplied from an external apparatus, and the second driving current being applied independently from the VIDEO signal.

6. The image forming apparatus according to claim 1, wherein the second light-intensity controller controls the second driving current in a margin region period in which laser emission corresponding to a margin region of a recording sheet is performed.

7. The image forming apparatus according to claim 1, wherein the intensity of light at the second emission level is changed in accordance with a change of a charged voltage applied by the charging unit.

8. The image forming apparatus according to claim 1, wherein the intensity of light at the second emission level is changed in accordance with a change of a charged potential of the charged photoconductor drum.

9. The image forming apparatus according to claim 1, wherein the first light-intensity controller controls the first driving current at least before a horizontal synchronization signal is detected, and the second light-intensity controller controls the second driving current at least in part of an image masking period and at least after the horizontal synchronization signal is detected.

10. The image forming apparatus according to claim 9, wherein the first light-intensity controller controls the first driving current with reference to a timing when a horizontal synchronization signal corresponding to a preceding scanning line is detected.

11. The image forming apparatus according to claim 1, wherein the second light-intensity controller controls the second driving current after the light emitting element emits a laser beam on a toner image forming region and before a horizontal synchronization signal corresponding to a next scanning line is detected.

12. The image forming apparatus according to claim 1, further comprising a first current source and a second current source, and the first and second light-intensity controllers are further configured to control the first and second driving currents according to currents of the first and second current sources, respectively.

13. The image forming apparatus according to claim 1, further comprising a detecting unit configured to measure intensity of light emitted from the light emitting element, and the first light-intensity controller is further configured to adjust the first driving current based on a deviation of the measured intensity from the intensity at the first emission level.

14. The image forming apparatus according to claim 1, further comprising a detecting unit configured to measure intensity of light emitted from the light emitting element, and the second light-intensity controller is further configured to adjust the second driving current based on a deviation of the measured intensity from the intensity at the second emission level.

15. The image forming apparatus according to claim 1, wherein the first and second light-intensity controllers are configured to perform the control of the first and second driving currents several times in one print job, respectively.

16. The image forming apparatus according to claim 1, further comprising a detector configured to detect light emitted in the laser emission region by the light emitting element and to output a synchronization signal, wherein the light emitting element emits light based on print data supplied from an external apparatus in an image section and the non-image section determined based on a timing when the synchronization signal is output.

* * * * *